US005490386A

United States Patent [19]

Keller et al.

[11] Patent Number: 5,490,386

[45] Date of Patent: Feb. 13, 1996

[54] METHOD FOR COOLING A LOW PRESSURE STEAM TURBINE OPERATING IN THE VENTILATION MODE

[75] Inventors: Herbert Keller; Dietmar Bergmann, both of Mülheim, Germany

[73] Assignee: Siemens Aktiengesellschaft, Munich, Germany

[21] Appl. No.: 206,798

[22] Filed: Mar. 7, 1994

[30] Foreign Application Priority Data

Sep. 6, 1991 [DE] Germany ..... 41 29 518.8

[51] Int. Cl.[6] ..... F01D 25/12; F01K 7/34

[52] U.S. Cl. ..... 60/660; 60/657; 60/662

[58] Field of Search ..... 60/657, 660, 662

[56] References Cited

U.S. PATENT DOCUMENTS

| | | | |
|---|---|---|---|
| 3,173,654 | 3/1965 | Roe | 415/1 |
| 3,817,654 | 6/1974 | Sohma | 415/103 |
| 4,309,873 | 1/1982 | Koran et al. | 60/662 |
| 4,353,216 | 10/1982 | Dickenson | 60/662 |

FOREIGN PATENT DOCUMENTS

| | | |
|---|---|---|
| 0213297 | 6/1986 | European Pat. Off. . |
| 365270 | 12/1922 | Germany . |
| 928346 | 5/1955 | Germany . |
| 1016719 | 10/1957 | Germany . |
| 1426887 | 5/1969 | Germany . |
| 3406071 | 8/1984 | Germany . |
| 3717521 | 11/1988 | Germany . |

OTHER PUBLICATIONS

Konstruktion Publication No. 5 (1958), A. Leitner, pp. 173–181 "Moderne westdeutsche Gross–Dampfturbinen".

Publication: Handbuchreihe Energie, vol. 3, 1985, (Bonn et al.) "Konzeption und Aufbau von Dampfkraftwerken";

*Primary Examiner*—Ira S. Lazarus
*Assistant Examiner*—L. Heyman
*Attorney, Agent, or Firm*—Herbert L. Lerner; Laurence A. Greenberg

[57] ABSTRACT

A method is provided for cooling a low pressure steam turbine operating in a ventilation mode. The low pressure steam turbine has a closable inlet through which steam can be delivered when operating in a power generation mode and which is blocked off when operating in ventilation mode, an outlet which communicates with a condenser for condensing the steam to condensate and a bleed port between the inlet and the outlet. A bleed pipe is connected to the bleed port for diverting steam and/or condensate during operation in the power generation mode. Steam is supplied through a steam transfer pipe to the bleed pipe in order to cool the low pressure steam turbine when operating in the ventilation mode. Condensate may also be supplied to the bleed pipe. The cooling effect in the low pressure steam turbine is largely limited to those components which suffer most when it is operating in the ventilation mode, and the cooling provisions are extracted from resources that are already available.

15 Claims, 3 Drawing Sheets

METHOD FOR COOLING A LOW PRESSURE STEAM TURBINE OPERATING IN THE VENTILATION MODE

CROSS-REFERENCE TO RELATED APPLICATION

This application is a continuation of International Application Serial No. PCT/DE92/00373, filed May 7, 1992.

BACKGROUND OF THE INVENTION

FIELD OF THE INVENTION

The invention relates to a method for cooling a low pressure steam turbine operating in the ventilation mode, in which the rotor of the steam turbine is rotated without any steam being admitted for expansion. Such a ventilation operation occurs, for example, in a multicylinder turbine set, in which provision is made for the possible diversion, ahead of the low pressure steam turbine and into a heat exchanger or the like, of the steam that would otherwise be expanded in the low pressure turbine.

In a multicylinder turbine set it is normal to couple the rotors of the individual turbines together and to connect them rigidly to the shaft of a generator or the like. All of the turbines of the turbine set therefore rotate synchronously, including any turbines that are not operating in the power generation mode because, for example, the steam is being used in some other manner.

There is no absolute vacuum present in a low pressure turbine operating in the ventilation mode. Instead there is a steam atmosphere having a static pressure which corresponds to that in the condenser which is connected to the low pressure turbine. The frictional interaction between the turbine blades and the steam (ventilation) can lead to a considerable generation of heat, as a result of which the turbine can be greatly heated, possibly to an inadmissibly high level. Cooling is therefore necessary to ensure safe ventilation operation.

Known cooling measures include the spraying of condensate in an atomized form into the outlet or, if the amount of cooling to be employed is particularly high, into the inlet of the turbine. The condensate vaporizes with a reduction in temperature and can therefore cool the ventilating turbine. The disadvantage is that the cooling effect of condensate sprayed in at the turbine outlet is severely limited, while spraying in condensate at the turbine inlet can lead to severe cooling of the turbine shaft, which is undesirable per se. On one hand, the cooling capacity to be employed is greatly increased and, on the other hand, the turbine shaft is subjected to undesirable stresses as a result of the cooling.

If the condensate is sprayed into the outlet, the cooling effect is often also restricted to those parts of the turbine near the outlet. If it is sprayed into the inlet, condensate can agglomerate in the inlet region and flooding can endanger the turbine blading.

Thermal power plants with steam turbines are described, for example, in German Published, Non-Prosecuted Applications 1 426 887 and DE 34 06 071 A1. The latter document concerns particular cooling measures in a steam turbine but those cooling measures are directed towards the operation of the steam turbines when generating power. Information regarding the structure of multicylinder steam turbine sets is given, for example, in European Patent No. 0 213 297 B1, concerning in particular the means of connection between the cylinders of a turbine set. General information regarding the structure of steam power plant is to be found in the "Handbuchreihe Energie (Energy Handbook Series)", published by Thomas Bohn, Technischer Verlag Resch, Gräfelfing, and Verlag TÜV-Rheinland, Cologne. In particular see Volume 5 which appeared in 1985, entitled: "Konzeption und Aufbau von Dampfkraftwerke [Design and Construction of Steam Power Stations]". A condenser for the water/steam cycle of a power station plant is described in German Published, Non-Prosecuted Application DE 37 17 521 A1.

U.S. Pat. No. 3,173,654 shows a method for cooling a steam turbine operating in the ventilation mode, in which, for cooling, condensate is sprayed into the steam turbine through a special distributing pipe configuration.

SUMMARY OF THE INVENTION

It is accordingly an object of the invention to provide a method for cooling a low pressure steam turbine operating in the ventilation mode, which overcomes the hereinaforementioned disadvantages of the heretofore-known methods of this general type and which is as efficient and careful or gentle as possible.

With the foregoing and other objects in view there is provided, in accordance with the invention, a method for cooling a low pressure steam turbine operating in a ventilation mode, which comprises delivering steam through a closable inlet of a low pressure steam turbine when operating in a power generation mode and blocking off the closable inlet when operating in a ventilation mode; feeding steam from an outlet of the low pressure steam turbine to a condenser for condensing the steam to condensate; diverting the steam and/or the condensate from a bleed port between the inlet and the outlet through a bleed pipe to a preheater during operation in the power generation mode; and supplying steam through a steam transfer pipe to the bleed pipe and thus to the bleed port.

It is advantageous for the steam introduced into the low pressure steam turbine at the bleed port to include a certain proportion of finely distributed condensate drops because such condensate drops evaporate in the low pressure steam turbine and in the process can absorb substantial amounts of heat. Such a steam/condensate mixture can be obtained directly by the extraction, at a suitable location in the thermal power plant, of steam due to be delivered to the low pressure steam turbine. Alternatively, the mixture can be formed by expanding the steam on the way to the bleed port or it can be prepared by mixing condensate into the steam.

It is not necessary for there to be a shut-off device directly at the inlet to the low pressure turbine to be cooled according to the invention. The inlet to the low pressure turbine can also be shut off by shutting off of an intermediate pressure turbine or a high pressure turbine being disposed upstream of the low pressure turbine and communicating with the latter (and, correspondingly, similarly ventilated). The turbine that is to be cooled according to the invention can also have a plurality of bleed ports.

An essential feature of the invention is that the cooling steam (or the cooling steam/condensate mixture) is introduced into the turbine at a bleed port and not at the inlet or outlet. In this way the cooling in the turbine is of particular benefit to the radially outer ends of the blades, which invariably suffer most because of their frictional interaction with the steam in the turbine. According to the invention, the cooling effect is therefore substantially limited to those regions of the turbine where it is desired. Cooling of other turbine components, which is generally undesirable for the reasons mentioned, is avoided.

A further advantage of the invention arises in steam turbine plants where the bleed pipes lead vertically downwards from the bled turbines. If a mixture of steam and condensate is delivered to such a bleed pipe, only steam and sufficiently small drops of condensate carried along with the steam reach the turbine. Larger drops, and condensate precipitating on the walls of the bleed pipe, are removed downwards and do not reach the turbine. Accordingly, in a turbine cooled according to the invention with a bleed pipe leading approximately vertically downwards, it is not necessary to provide special water removal devices, by means of which the condensate formed from the large drops, and which hardly evaporates at all, must be extracted from the turbine.

In accordance with an additional mode of the invention, there is provided a method which comprises supplying condensate to the bleed pipe in addition to the steam, in particular by spraying condensate through a condensate transfer pipe into the steam transfer pipe and/or into the bleed pipe.

In accordance with another mode of the invention, it is particularly advantageous to mix the condensate with the steam in an atomizing nozzle, and to spray it from this atomizing nozzle into the bleed pipe. Condensate distributed in fine droplets, with a droplet diameter smaller than about 0.1 mm is desirable. This produces a particularly high cooling effect because of the vaporization that occurs as heat is absorbed in the turbine which has to be cooled.

In accordance with a further mode of the invention, the condensate to be supplied to the bleed pipe is branched off from the main condensate pipe behind a condensate pump delivering the condensate. This avoids the need for a special delivery device for the condensate to be used within the context of the invention.

In accordance with an added mode of the invention, the method is controlled in such a manner that in the ventilating, low pressure turbine being cooled according to the invention, a temperature is measured at a measuring station between the bleed port and the outlet, and the supply of steam, or steam/condensate mixture, to the bleed pipe, is regulated as a function of this temperature.

In accordance with an additional mode of the invention, the supply of steam, or steam and condensate, to the bleed pipe is limited in such a way that in the low pressure turbine there is a flow of steam corresponding in order of magnitude to about 1% of the flow of steam during operation in power generation mode. A steam flow of this order of magnitude permits sufficient cooling of the turbine in accordance with the invention but does not produce so much work that the speed control of the turbine set, of which the cooled turbine is a part, could be impaired.

In accordance with yet another mode of the invention, there is provided a method which comprises extracting the steam for cooling the low pressure steam turbine (which is more useful if it contains a certain proportion of finely divided drops of condensate) from a condensate tank which is often provided in steam power plants, and is used for the collection, heating and degassing of condensate. Heating steam is usually supplied to such a condensate tank for the purpose of degassing the condensate. The thermodynamic conditions in the condensate tank are always held very constant by these means. The condensate tank therefore represents a preferred reservoir for steam to be used according to the invention because the steam extracted from the steam space in the condensate tank is always replaced immediately by condensate evaporating. Due to the small quantities of steam required by the invention, there are no substantial alterations to the thermodynamic conditions in the condensate tank. Steam from the condensate tank is saturated because of the coexistence of steam and condensate and it may even be mixed with finely divided condensate and is therefore particularly suitable for use within the context of the invention. In accordance with yet a further mode of the invention, there is provided a method which comprises extracting the steam to be supplied to the bleed pipe according to the invention from a steam by-pass pipe which diverts steam around the low pressure turbine when the latter is operating in ventilation mode. Such a steam by-pass pipe may, for example, direct the steam from a high pressure steam turbine located ahead of the low pressure steam turbine (or alternatively from a configuration of a high pressure steam turbine and an intermediate pressure steam turbine) around the low pressure steam turbine to a heating device or the like, where the steam may, perhaps, be cooled down and condensed. It is particularly useful to obtain a steam/condensate mixture by extracting the steam to be supplied to the bleed pipe from such a heating device.

In accordance with a concomitant mode of the invention, there is provided a method which comprises extracting the steam to be supplied to the bleed pipe from a high pressure or intermediate pressure steam turbine located upstream of the low pressure steam turbine directly or indirectly (for example, from a preheater or the like which is fed by the high pressure or intermediate pressure steam turbine). The steam extracted from a location in the steam/condensate circuit upstream of the low pressure steam turbine usually has an intrinsically sufficiently high pressure and can therefore be supplied to the bleed pipe without the necessity for special pumps or the like for this purpose. Steam at a sufficiently high pressure can also be transformed by means of expansion into a steam/condensate mixture, which is particularly convenient for the cooling of the low pressure steam turbine according to the invention.

Other features which are considered as characteristic for the invention are set forth in the appended claims.

Although the invention is illustrated and described herein as embodied in a method for cooling a low pressure steam turbine operating in the ventilation mode, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
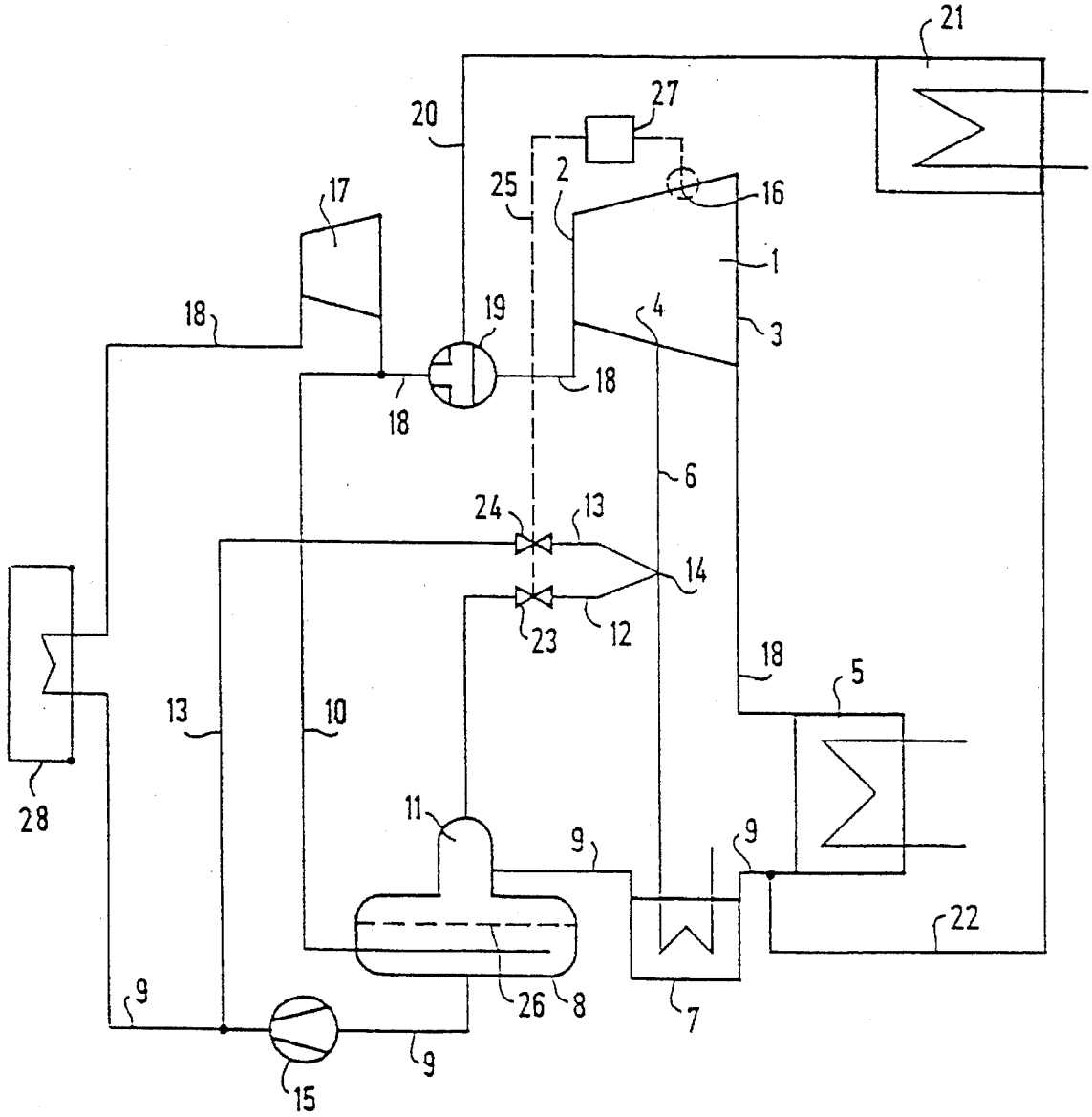
FIG. 1 is a schematic circuit diagram of an embodiment of part of a thermal power plant, in which a working medium, in particular water, is guided around a closed cycle.
Figure 2:
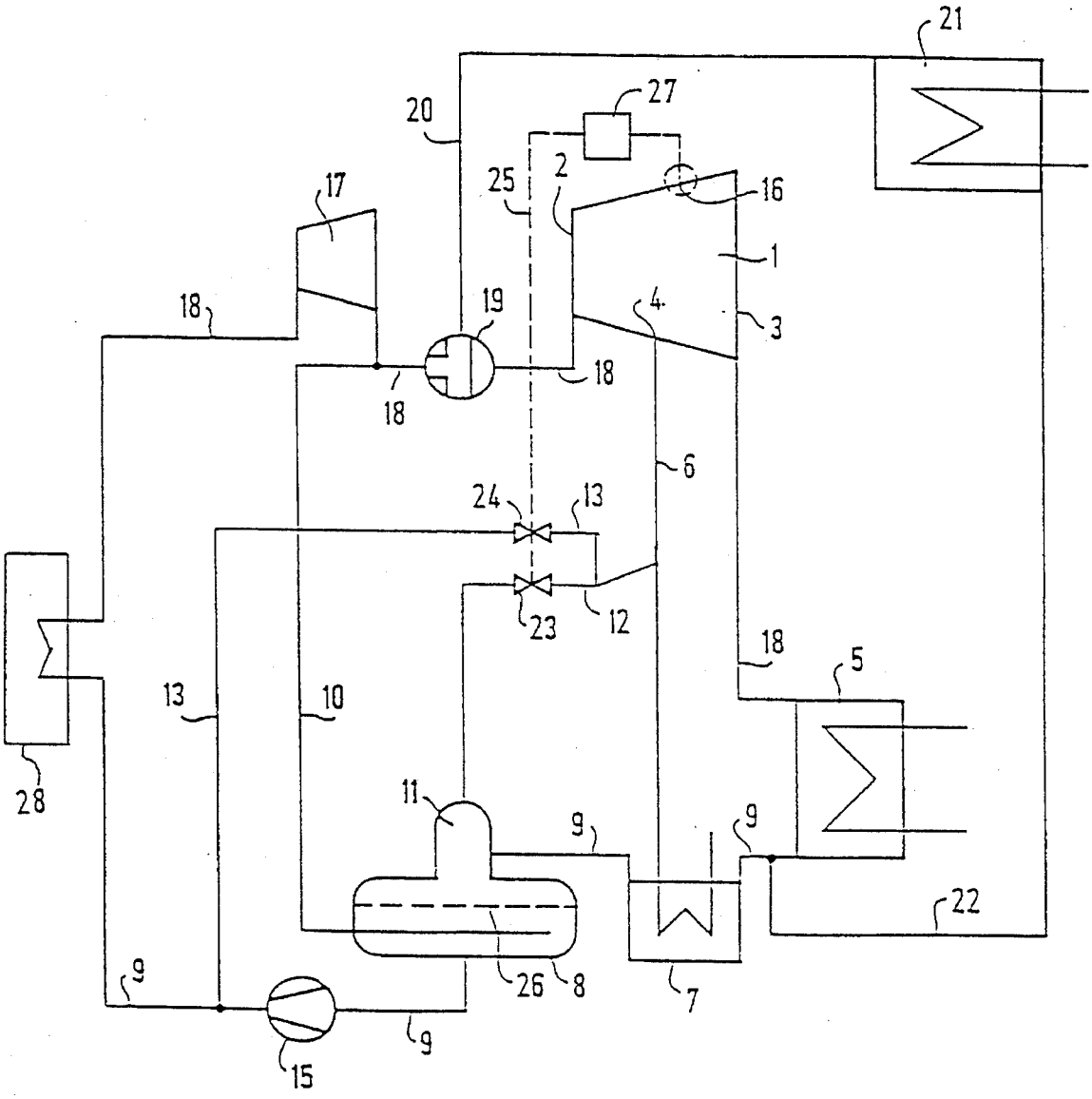
FIG. 2 is a similar view of a second embodiment thereof.
Figure 3:
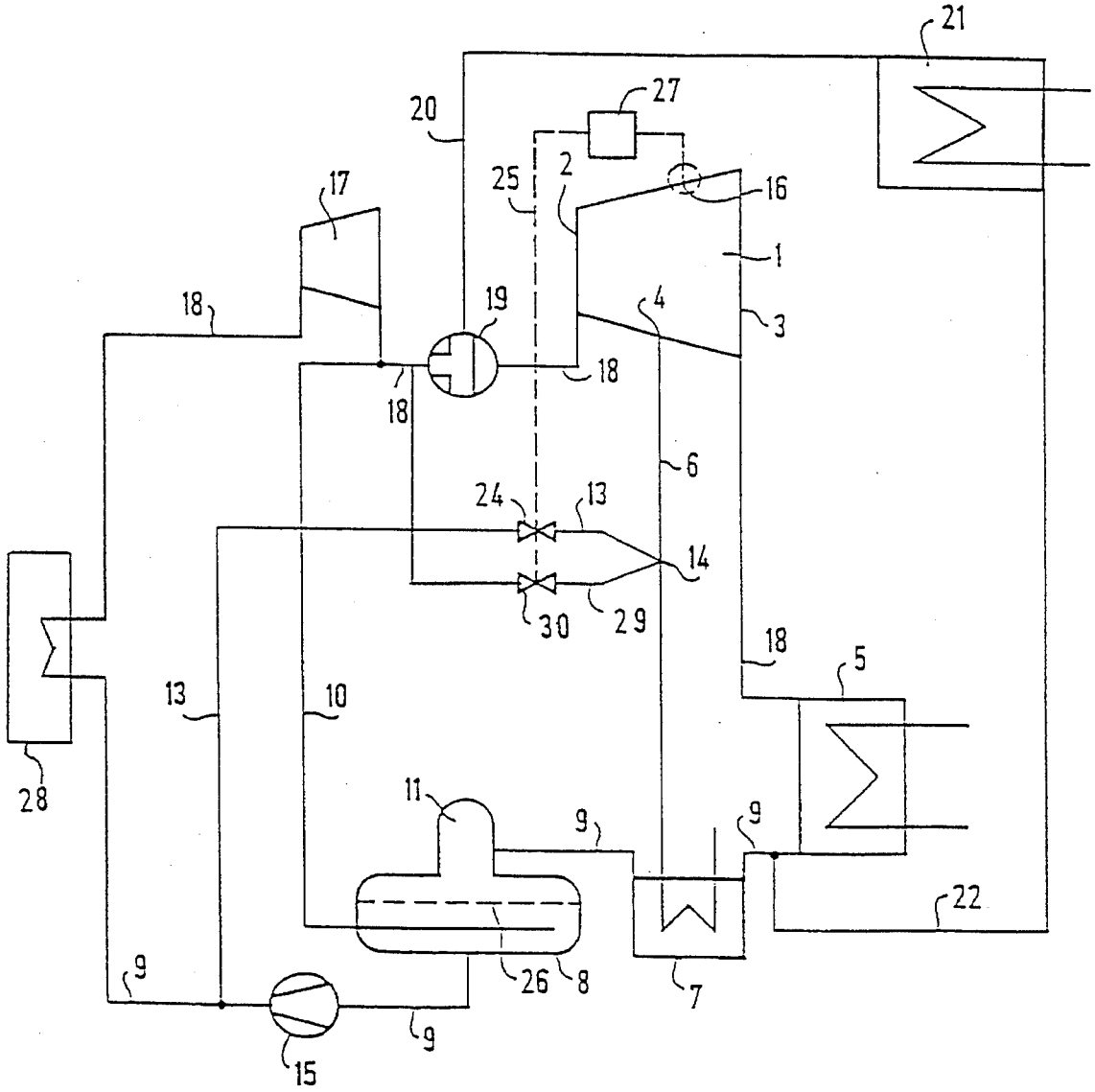
FIG. 3 is a similar view of a third embodiment thereof.

Referring now to the figures of the drawing in detail, there is seen a cycle which includes a high pressure steam turbine 17, a low pressure steam turbine 1, a condenser 5, a preheater 7, a condensate tank 8, and a boiler 28. Further components of the cycle are not shown. For the sake of clarity, only a single high-pressure steam turbine 17 is shown. However, the invention can, of course, be used in cycles in which there are three or more turbine cylinders, or in which a turbine is not constructed to be single-flow as represented, but rather to be double-flow. Again, the representation of a single preheater 7 should not exclude the applicability of the invention to cycles in which a plurality of preheaters 7 are disposed. The illustrated cycle components are connected together by means of steam connecting pipes 18 and main condensate pipes 9. A condensate pump 15 is included in the main condensate pipe 9. This condensate pump 15 may also represent a number of such condensate pumps 15. A switching point 19 is disposed between the high pressure steam turbine 17 and the low pressure steam turbine 1 in the steam connecting pipe 18. The switching point 19 is usually configured in the form of butterfly valves and by means of the switching point 19 the steam flowing out of the high pressure steam turbine 17 can be diverted through a steam by-pass pipe 20 to a heat exchanger 21, so that steam is not admitted to the low pressure steam turbine 1, depending on the setting of the switching point 19. The heat exchanger 21 symbolizes a number of possibilities for the use of the steam flowing from the high pressure steam turbine 17. In the example shown, the steam supplied to the heat exchanger 21 is condensed in the latter and flows as condensate through a condensate return pipe 22 back into the main condensate pipe 9 upstream of the preheater 7.

The low pressure steam turbine 1 is to be rigidly coupled to the high pressure steam turbine 17, so that the rotors of the two steam turbines 1 and 17 run synchronously. Therefore, if the steam flowing out of the high pressure steam turbine 17 is diverted through the steam by-pass pipe 20, the low pressure steam turbine 1 runs at no load. Since the static pressure in this low pressure steam turbine 1 corresponds to the steam pressure in the condenser 5, friction occurs. However, no heat is removed by loss of energy of steam as it expands in the low pressure steam turbine during the power generation mode. It may therefore be necessary to provide cooling to permit ventilation mode operation of the low pressure steam turbine 1.

Steam is admitted to the low pressure steam turbine 1 at an inlet 2, and expanded steam leaves the low pressure steam turbine 1 by an outlet 3 leading to the condenser 5. A bleed port 4 is disposed between the inlet 2 and the outlet 3 for the removal of condensate forming as a result of the expansion of the working steam in the low pressure steam turbine 1 when the latter is operating in the power-generation mode, or for bleeding off steam to heat the preheater 7. A bleed pipe 6 is connected to the bleed port 4. The bleed pipe 6 leads from the bleed port 4 to the preheater 7, where the working medium being bled off is used to preheat condensate from the condenser 5. There are several possibilities for removing the working medium that was bled off from the bleed port 4, from the preheater 7. After flowing through the preheater 7, the medium can, for example, flow through further non-illustrated preheaters and can finally be united with the condensate in the main condensate pipe 9. The condensate flows through the main condensate pipe 9 into the condensate tank 8 (which is sometimes called a "degasser"). In the condensate tank 8, the condensate is heated by means of steam which is introduced through a heating steam pipe 10 into the condensate beneath a condensate surface level 26. This heating serves, inter alia, to remove gases (such as oxygen) from the condensate. Above the condensate surface level 26 in the condensate tank 8, there is a steam space 11 filled with steam. Steam is extracted from this steam space 11 and supplied through a steam transfer-pipe 12 to the bleed pipe 6. In addition, condensate flows towards the bleed pipe 6 through a condensate transfer pipe 13. Steam and condensate are sprayed together through a diagrammatically illustrated atomizing nozzle 14, into the bleed pipe 6. A mixture of steam and fine condensate drops forms in the bleed pipe 6 and flows into the low pressure steam turbine 1 at the bleed port 4 for cooling purposes. The condensate transfer pipe 13 opens into the main condensate pipe 9 after the condensate pump 15. It is not necessary for the condensate and steam to be supplied to the bleed pipe 6 through a single atomizing nozzle 14, but instead the steam and condensate can also be delivered independently of each other to the bleed pipe 6. In order to limit the flow of steam in the low pressure turbine, if necessary a choked nozzle can be fitted in the steam transfer pipe 12. In order to control the cooling of the low pressure steam turbine 1 during operation in the ventilation mode, with no power being produced, temperature is measured at a measuring station 16 disposed in the turbine between the bleed port 4 and the outlet 3. This temperature measurement is evaluated at a control device 27 and transmitted through a control line 25 to a steam control valve 23 in the steam transfer pipe 12, as well as to a condensate control valve 24 in the condensate transfer pipe 13.

Finally, it should be noted that it is not absolutely essential for the steam transfer pipe 12 and the condensate transfer pipe 13 to be completely shut off when the low pressure steam turbine 1 is operating in the power generation mode. A small flow of steam or condensate can be maintained to the bleed pipe 6 through small by-pass pipes, which by-pass the steam control valve 23 and the condensate control valve 24. This can, under certain circumstances, be advantageous in maintaining the temperatures of the steam transfer pipe 12 and the condensate transfer pipe 13.

If there is no condensate tank 8 available from which steam can be removed for feeding into the bleed port 4 of the low pressure steam turbine 1, such steam can be extracted from the steam connecting pipe 18 between the high pressure steam turbine 17 and the low pressure steam turbine 1, or from the steam by-pass pipe 20, or possibly even from the heat exchanger 21. Removal of the steam from a non-illustrated preheater associated with the high pressure steam turbine 17, is also conceivable. Since the high pressure steam turbine 17 continues to operate in the power generation mode when the low pressure steam turbine 1 is operating in the ventilation mode, it may be assumed that the thermodynamic conditions are very stable both in the high pressure steam turbine 17 itself and in the auxiliary devices which communicate directly with it. There are therefore no problems associated with the inclusion of these items into the system, according to the invention, for cooling the ventilating low pressure steam turbine 1.

The method according to the invention for cooling a low pressure steam turbine operating in the ventilation mode, is particularly economical in energy, because it relies on resources that are, to a large extent, already available. It avoids material stresses because of the fact that the cooling is effective, in the main, only in those parts of the low pressure steam turbine where it is desirable.

We claim:

1. A method for cooling a low pressure steam turbine operating in a ventilation mode, which comprises:

delivering steam through a closable inlet of a low pressure steam turbine when operating in a power generation mode and blocking off the closable inlet when operating in a ventilation mode;

feeding steam from an outlet of the low pressure steam turbine to a condenser for condensing the steam to condensate;

diverting at least one of the steam and the condensate from a bleed port between the inlet and the outlet through a bleed pipe to a preheater during operation in the power generation mode; and supplying steam from outside the low pressure steam turbine through a steam transfer pipe to the bleed pipe in the ventilation mode.

2. The method according to claim 1, which comprises additionally supplying condensate to the bleed pipe through a condensate transfer pipe.

3. The method according to claim 2, which comprises spraying the condensate into the steam transfer pipe.

4. The method according to claim 2, which comprises spraying the condensate into the bleed pipe.

5. The method according to claim 4, which comprises spraying the condensate through an atomizing nozzle into the bleed pipe, mixing the condensate with the steam and atomizing the condensate in the atomizing nozzle.

6. The method according to claim 4, which comprises diverting the condensate to be supplied to the bleed pipe from a main condensate pipe downstream of a condensate pump.

7. The method according to claim 2, which comprises spraying the condensate into the steam transfer pipe and into the bleed pipe.

8. The method according to claim 1, which comprises:

a) measuring a temperature at a measuring station in the low pressure turbine between the bleed port and the outlet; and b) regulating the supply of steam to the bleed pipe as a function of the temperature.

9. The method according to claim 1, which comprises:

a) measuring a temperature at a measuring station in the low pressure turbine between the bleed port and the outlet; and b) regulating the supply of condensate to the bleed pipe as a function of the temperature.

10. The method according to claim 1, which comprises:

a) measuring a temperature at a measuring station in the low pressure turbine between the bleed port and the outlet; and b) regulating the supply of steam and condensate to the bleed pipe as a function of the temperature.

11. The method according to claim 1, which comprises limiting the supply of steam to the bleed pipe for producing a flow of steam in the low pressure turbine being at most approximately 1% by mass of a maximum flow of steam in the low pressure turbine when operating in the power generation mode.

12. The method according to claim 1, which comprises limiting the supply of steam and condensate, to the bleed pipe for producing a flow of steam in the low pressure turbine being at most approximately 1% by mass of a maximum flow of steam in the low pressure turbine when operating in the power generation mode.

13. The method according to claim 1, which comprises supplying the condensate from the condenser through the preheater and through a main condensate pipe to a condensate tank, in which the condensate can be heated by the introduction of steam through a heating steam pipe and from which steam is extracted from a steam space and supplied to the bleed pipe.

14. The method according to claim 1, which comprises extracting steam to be supplied to the bleed pipe from a steam by-pass pipe through which steam is supplied during the ventilation operation of the low pressure steam turbine.

15. The method according to claim 1, which comprises extracting steam to be supplied to the bleed pipe from a high pressure steam turbine upstream of the low pressure steam turbine.

* * * * *